US008083108B2

(12) United States Patent
Smith et al.

(10) Patent No.: US 8,083,108 B2
(45) Date of Patent: Dec. 27, 2011

(54) DISPENSING CAPS FOR LIQUID CONTAINERS

(75) Inventors: Matthew Eric Smith, Isle of Man (GB); Karl Mondszein, Mansfield (GB)

(73) Assignee: Carbonite Corporation, WTC (PA)

( * ) Notice: Subject to any disclaimer, the term of this patent is extended or adjusted under 35 U.S.C. 154(b) by 849 days.

(21) Appl. No.: 11/921,383

(22) PCT Filed: May 12, 2006

(86) PCT No.: PCT/GB2006/001771

§ 371 (c)(1),
(2), (4) Date: Jun. 30, 2008

(87) PCT Pub. No.: WO2006/129053

PCT Pub. Date: Dec. 7, 2006

(65) Prior Publication Data

US 2008/0314937 A1 Dec. 25, 2008

(30) Foreign Application Priority Data

May 31, 2005 (GB) ..... 0511081.2

(51) Int. Cl.
*B67D 7/06* (2010.01)

(52) U.S. Cl. ..... 222/525; 222/522

(58) Field of Classification Search ..... 222/499, 222/498, 522, 511, 544, 496, 559, 537, 525–529, 222/514, 518, 512, 513
See application file for complete search history.

(56) References Cited

U.S. PATENT DOCUMENTS

| | | | | | |
|---|---|---|---|---|---|
| 1,949,058 | A | * | 2/1934 | Leguillon | 222/529 |
| 2,643,394 | A | * | 6/1953 | Wood | 4/287 |
| 2,829,380 | A | * | 4/1958 | Wood | 4/287 |
| 3,321,114 | A | * | 5/1967 | Croyle | 222/499 |
| 3,658,217 | A | * | 4/1972 | Collie et al. | 222/463 |
| 4,691,836 | A | * | 9/1987 | Wassilieff | 215/298 |
| 5,240,154 | A | | 8/1993 | Van Den Berghe | |
| 5,358,154 | A | | 10/1994 | Halm | |
| 5,597,096 | A | * | 1/1997 | Jeppesen et al. | 222/498 |
| 7,806,289 | B2 | * | 10/2010 | McCandlish et al. | 220/713 |

FOREIGN PATENT DOCUMENTS

| | | |
|---|---|---|
| DE | 85 18 074.2 | 2/1986 |
| EP | 0 790 192 | 8/1997 |
| EP | 04253092.3 | 5/2004 |
| EP | 1 600 395 | 11/2005 |
| WO | 94/14588 | 7/1994 |

* cited by examiner

*Primary Examiner* — Kevin P Shaver
*Assistant Examiner* — Robert Nichols
(74) *Attorney, Agent, or Firm* — Cowan, Liebowitz & Latman

(57) ABSTRACT

A dispensing cap for a beverage container constitutes a one-piece moulding of plastic material including a first circular section tubular portion for connection to the mouth of a liquid container and a second circular section tubular portion carrying a radially projecting circumferential flange, one end of the first tubular portion being connected to one end of the second tubular portion by a resilient, annular, integral web in which one or more flow openings are formed, the first and second tubular portions being coaxial and relatively movable in the axial direction between an open and closed position. The moulding further including two half shells of semi-cylindrical shape, the upper edge of each is integral with and sealed to the circumferential flange, the lower edge forms a sliding seal with the first tubular portion, whereby within the two half shells, there is a liquid flow space.

11 Claims, 4 Drawing Sheets

DISPENSING CAPS FOR LIQUID CONTAINERS

CROSS-REFERENCES TO RELATED APPLICATIONS

This application claims priority to International Application No. PCT/GB2006/001771 filed May 12, 2006, which claims priority to Great Britain Application No. 0511081.2 filed May 31, 2005, the entire disclosures of which are hereby incorporated by reference.

The present invention relates to dispensing caps for containers for beverages or other liquid or flowable materials, such as liquid detergent, moisturising cream or mustard. Specifically, the invention relates to a dispensing cap of the type constituting a one-piece moulding of polymeric material including a first circular section tubular portion with a first radius for connection to the mouth of a liquid container and a second circular section tubular portion with a second radius smaller than the first radius, one end of the first tubular portion being connected to one end of the second tubular portion by a resilient, annular, integral web, in which one or more flow openings are formed, the width of the web being equal to or greater than the difference between the first and second radii, the other end of the second tubular portion being closed, one of the web and the internal surface of the first tubular portion adjacent to the said one end thereof being connected to a projecting annular first sealing flange, the first and second tubular portions being coaxial and relatively movable in the axial direction between an open position, in which the second tubular portion is located outside the first tubular portion and the flow openings are not obstructed and a closed position, in which the said one end of the second tubular portion is located within the said one end of the first tubular portion and the sealing flange is in sealing engagement with the other of the web and the internal surface of the first tubular portion, whereby the flow openings are prevented from communicating with the interior of the first tubular portion by the sealing engagement of the first sealing flange with the other of the web and the internal surface of the first tubular portion.

A dispensing cap of this type is disclosed in DE G 8518074.2, though the cap disclosed therein is only suitable for use with powder material and does not form an adequate seal for use with liquids.

European Patent Application Number 04253092.3, which does not form part of the state of the art, also relates to a dispensing cap of this type. Specifically, this document relates to a dispensing cap for a beverage container constituting one-piece plastic moulding comprising a first tubular portion of relatively large radius of which one end is intended for connection to the container and the other end is connected to one end of a second tubular portion of smaller radius by a resilient annular web, whose width is greater than the difference between the two radii and in which one or more flow openings are formed. A sealing flange is connected to the internal surface of the annular web. The second tubular portion is bistably moveable between an open position, in which the second tubular portion is located outside the first tubular portion and the contents of the container may be dispersed through the flow openings, and a closed position, in which the lower end of the second tubular portion is located within the first tubular portion and the sealing flange is in sealing engagement with the internal surface of the first tubular portion, whereby the flow openings are sealed from the interior of the first tubular portion and the contents of the container may therefore not be dispensed.

Whilst the dispensing cap described in the prior application is extremely effective, the dispensed liquid discharges, from openings situated in the annular web, which is inherently inclined to the axis of the closure, at positions which are intermediate the axial ends of the closure cap. It is now thought that this may be inconvenient, at least for certain applications.

It is therefore the object of the invention to provide a dispensing cap of the type disclosed in the prior application but which is constructed so that the liquid is dispensed in the axial direction through openings situated in the upper or free end surface of the cap.

According to the present invention, a dispensing cap of the kind referred to above is characterised in that the said other end of the second tubular portion carries a radially projecting circumferential flange, that one or more flow openings are formed in the circumferential flange, that the moulding further includes two half shells of semi-cylindrical shape, the upper edge of each of which is integral with and sealed to the circumferential flange, the lower edge of each of which forms a sliding seal with the first tubular portion and each side edge of each of which forms a seal with a side edge of the other of which, whereby defined within the two half shells, there is a liquid flow space with which the flow openings in the web and in the circumferential flange communicate.

Thus the drinking cap in accordance with the invention includes two circular section tubular portions of different radius, one end of each of which is connected by a resilient web whose width, that is to say length in the generally radial direction, is equal to or greater than the difference between the two radii. The other end of the tubular portion of greater radius is adapted for connection to the mouth of a bottle or the like whilst the other end of the tubular portion of lesser radius is closed. The resilient web has at least one and preferably a number of spaced flow openings formed in it. Either the web or the internal surface of the tubular portion of greater diameter carries a sealing flange. The tubular portion of lesser diameter is thus movable in the axial direction with respect to the other tubular portion between an open position, in which it is situated wholly outside the tubular portion of greater diameter and the flow openings are unobstructed, and a closed position in which its end connected to the web is situated inside the adjacent end of the tubular portion of greater diameter. In the open position, liquid can flow out of the container through the flow apertures and into the space defined by the outer surfaces of the two tubular portions, the inner surface of the two half shells and the underside of the radial flange. This space communicates with the flow openings in the flange and the liquid can thus flow out through these openings and thus out through the upper surfaces of the flange in the generally axial direction. In the closed position, the flow apertures in the web are situated within the tubular portion of greater diameter and the sealing flange is in sealing engagement with the other of the web and the internal surface of the tubular portion of greater diameter, thereby sealing the flow openings from the interior of the tubular portions. This means that the container to which the dispensing cap is connected is also sealed and thus that no liquid may leave it.

It will be appreciated that when the two tubular portions are in the open position and a force is applied to the tubular portion of smaller diameter to move it into the closed position, the initial movement of the tubular portion of the smaller diameter will necessarily result in compression and/or deformation of the web due to the fact that its length is greater than the difference between the radii of the two tubular portions. This compression and/or deformation will result in the web exerting a restoring force on the tubular portion of lesser diameter urging it back towards the open position. However, as the closing force continues to be exerted, the tubular portion of smaller diameter will move progressively in the axial direction towards the tubular portion of greater diameter. As it passes through the position in which the web extends substantially in the radial direction, the force exerted by the web on the tubular portion of smaller diameter will act on it to urge it towards the closed position. The tubular portion of smaller diameter is thus effectively bistable and if no external force is applied to it it will automatically move to either the open or the closed position. The sealing flange is positioned and dimensioned such that it is moved into sealing contact with the opposing surface on either the internal surface of the tubular portion of larger diameter or the web before the web has reached the fully relaxed position. This means that, in the closed position, the sealing flange is biased into contact with the opposing surface and forms a constant substantially line seal with it.

The two half shells form a continuous annular seal with the radial flange and with each other along their adjoining edge surfaces and a sliding surface seal with the first or lower tubular portion and thus define a substantially sealed chamber which communicates with the two sets of flow apertures and thus serves to transfer the position at which liquid discharges from the cap from its side surface to its upper or end surface.

It is preferred that the first sealing flange is integral with the web. It is preferred further that the first sealing flange projects from the web in a direction substantially parallel to the axis of the first and second tubular portions, when they are in the open position. This is particularly convenient because it enables the drinking cap to be readily removed from an injection mould at the end of the injection moulding process in the axial direction. It is also convenient because the web, and thus the first sealing flange integral with it, will typically rotate through about 90° when moving from the open to the closed position, which means that if the first sealing flange extends in the axial direction, when the cap is in the open position, it will extend in the generally radial direction, when the cap is in the closed position, which will mean that its free edge will form a substantially line seal with the opposing surface.

Whilst the first sealing flange may form a seal directly with the internal surface of the tubular portion of greater diameter, it is preferred that the internal surface of the first tubular portion carries a resilient annular second sealing flange, which projects at an acute angle to the axis of the first of the first and second tubular portions and away from the second tubular portion and is positioned so that it is sealingly engaged by the first sealing flange, when the first and second tubular portions are in the closed position. This second sealing flange will be caused to yield somewhat in the generally radial direction by the engagement of the first sealing flange and this is found to result in a further enhancement of the sealing integrity.

In the preferred embodiment, each half shell is integrally connected to the circumferential flange substantially at the mid point of its upper edge by means of a hinge, the upper edge of each half shell and the corresponding portion of the circumferential flange being of complimentary shape and snap connected together. The integral connection of the half shells to the flange means that the entire cap may be produced in the form of an injection moulding. It is, however, of course not possible to mould the cap in the configuration in which the half shells define the liquid flow space or chamber and thus subsequent to moulding the two half shells are moved to the appropriate position in which they are snap connected to the flange and to each other.

Further features and details of the invention will be apparent from the following description of one specific embodiment of dispensing cap in accordance with the invention, which is given by way of example only with reference to the accompanying drawings, in which.

Figure 1:
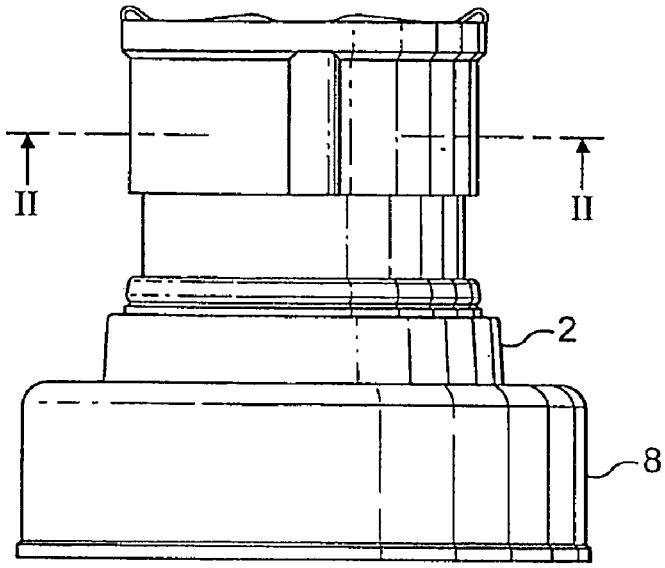
FIG. 1 is a side view of a dispensing cap in accordance with the invention in the open position.
Figure 2:
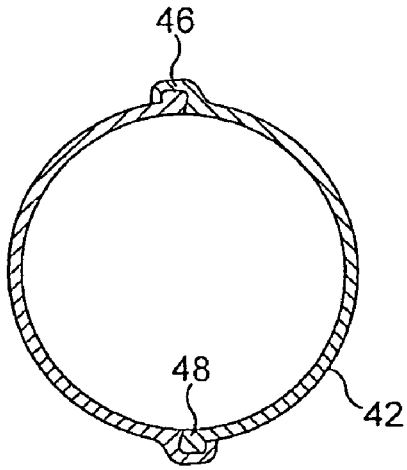
FIG. 2 is a sectional view on the line II-II in FIG. 1.
Figure 3:
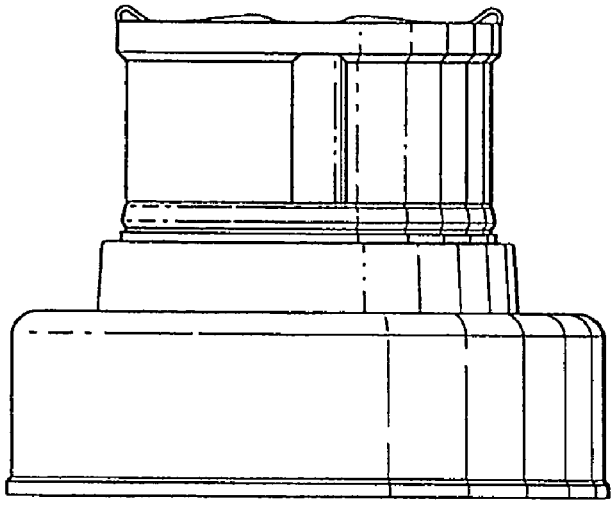
FIG. 3 is a side view of the cap in the closed position.

The dispensing cap is a one-piece injection moulded component of polymeric material, such as polypropylene, and comprises a first circular section tubular portion 2 of relatively large diameter, which is integrally connected at one end by a resilient, flexible web 4 to one end of a second circular section tubular portion 6 of relatively smaller diameter. It is not necessary that the two tubular portions be of constant diameter or parallel sided and it will be seen that the wall of the second tubular portion is downwardly divergent.

The larger tubular portion 2 is adapted to be connected to the neck of a bottle. For this purpose, its diameter may be substantially the same as that of the neck of the bottle to which it is to be connected or, as in this case, it may be integral with a circular section connector portion 8 of yet greater diameter, that is to say with an internal diameter substantially equal to the external diameter of the neck of the bottle. The connector portion 8 may be connected to the bottle in any convenient manner but in the present case it is provided with internal screw threads 10 for cooperation with corresponding screw threads on the exterior of the neck of the bottle, which is not shown. The upper end of the smaller diameter tubular portion 6 is closed by an integral lid 14, the diameter of which is greater than that of the tubular portion 6, whereby its radially outer edge constitutes a projecting flange or lip 16, in which one or more, in this case four, flow openings 17 are formed.

Figure 4:
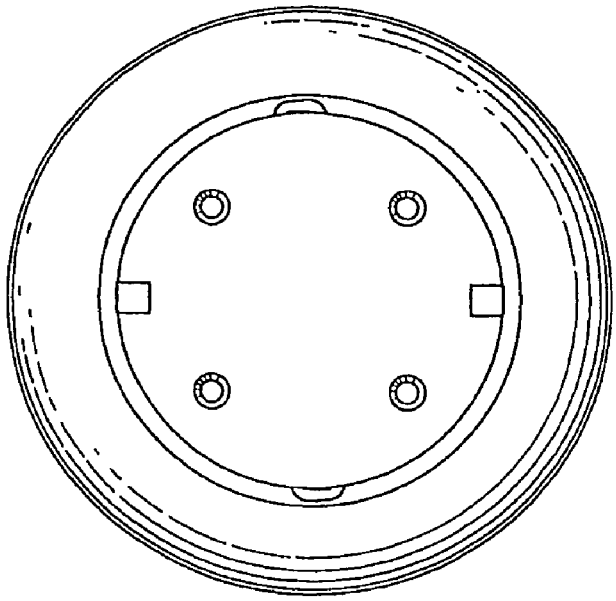
FIG. 4 is a plan view of the cap.
Figure 5:
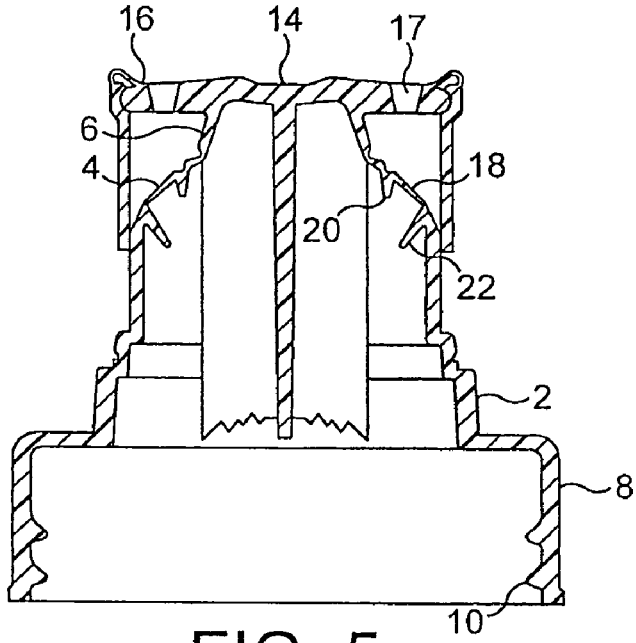
FIG. 5 is an axial sectional view of the cap in the open position.
Figure 6:
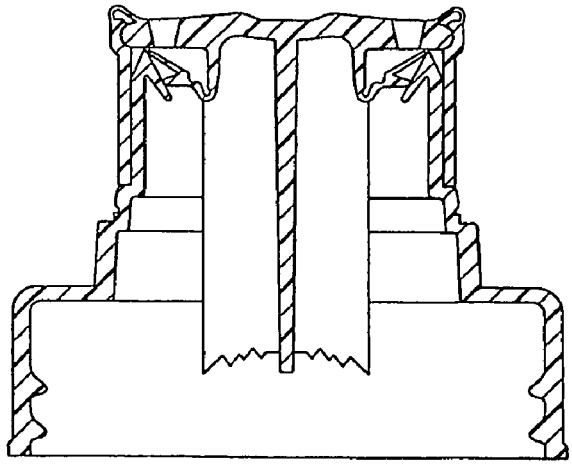
FIG. 6 is an axial sectional view of the cap in the closed position.

As may be seen in FIG. 5, a plurality of holes 18 is formed in the resilient web 4. As best seen in FIG. 4, the width of the resilient web 4, that is to say its length between the lower end of the tubular portion 6 and the upper end of the tubular portion 2, is greater than the difference between the radii of the two tubular portions. Integral with the internal surface of the web 4 at a point its radially inner and outer edges is a first annular sealing flange 20, which extends substantially in the axial direction, when the cap is in the open position illustrated in FIG. 5. Integral with the internal surface of the upper end of the larger tubular portion 2 is a second resilient sealing flange 22, which extends both downwardly, that is to say away from the smaller diameter tubular portion 6, and inwardly towards the axis of the cap, whereby it subtends an acute angle with the axial direction of the cap.

When the cap is in the open position shown in FIGS. 1 and 5, the tubular portion 6 is located wholly outside the tubular portion 2. The web 4 also extends upwardly out of the tubular portion 2 and also inwardly in the axial direction and the flow openings 18 communicate with the interior of the cap, whereby liquid in the container to which the cap is connected can flow out through the openings 18. If a downward force is exerted on the cap 14, the tubular portion 6 begins to move downwardly. This results in compression and distortion of the web 4, which thus exerts a restoring force on the tubular portion 16 urging it back towards the full open position. As the force continues to be exerted on the cap 14, the tubular portion 6 moves downwardly until the web 4 extends approximately horizontally, that is to say in the radial direction. As the tubular portion 6 moves through and beyond this "dead centre" position, the force exerted by the web 4 on the tubular portion 6 acts in the downward direction. The tubular portion 6 continues to move downwardly and this is accompanied by continuing rotation of the web 4. This movement continues until the free edge of the sealing flange 20 engages the surface of the resilient sealing flange 22. This occurs before the web 4 is fully relaxed, whereby when the downward force on the cap 14 is removed, the force exerted by the web 4 continues to urge the two sealing flanges into contact and the free edge of the flange 20 makes sealed line contact with the surface of the sealing flange 22. This contact line is situated below the flow openings 18, which means that these flow openings are sealed from the interior of the cap. The interior of the bottle is thus sealed and no liquid can flow out through the openings 18. If it is desired to reopen the bottle, an upward force is exerted on the annular projection or ledge 16 and the process described above is reversed until the cap is again in the open position illustrated in FIGS. 1 and 5.

Figure 7:
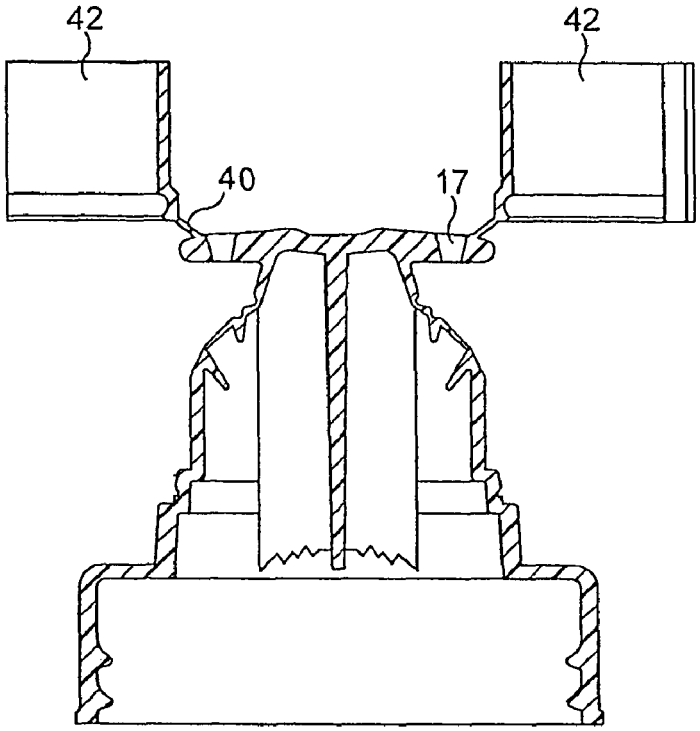
FIG. 7 is an axial sectional view of the cap in the configuration in which it leaves the mould.

Moulded integrally with the flange 16 and connected to it by respective diametrically opposed integral hinges or tabs 40 are two semi-cylindrical shells 42. FIG. 7 shows the positions of the shells 42 relative to the remainder of the cap when it is ejected from the injection mould in which it is made. The semi-circular edge of each shell closest to the flange 16 is formed with a snap fit formation 44 complementary to the outer edge of the flange 16. The two straight edges extending in the axial direction of each shell are also formed with complementary snap formations, one edge on each shell having generally a hook or U channel profile 46, the other edge having a complementary radial projection 48.

Figure 8:
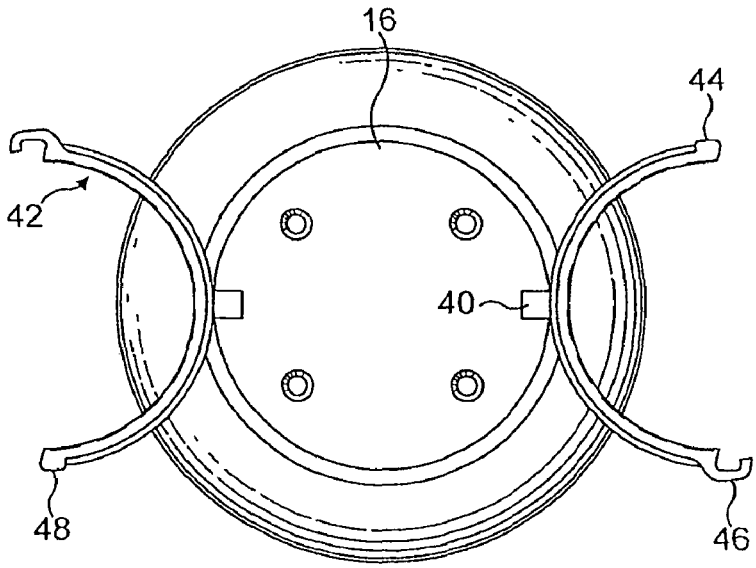
FIG. 8 is a plan view of the cap shown in FIG. 7.

After the cap has been moulded, the two shells are rotated in opposite senses through 180° from the positions shown in FIGS. 7 and 8. As the upper edges of the shells move into progressive engagement with the outer edge of the flange 16 they form a sealed snap connection. As the two pairs of opposed complementary edges of the shells come into contact, the material of the channel sections 46 is deformed around and then mates with the complementary projections 48, thereby forming further snap seals. The inner surface of the lower portion of each shell is retained in contact with the outer cylindrical surface of the lower tubular portion and forms a sliding seal with it. Thus as the tubular portion 2 is moved up and down relative to the tubular portion 4, the seal is maintained at the lower edge of the shells 42 and no leakage of liquid can occur.

Thus once the two shells have been moved from the positions shown in FIGS. 7 and 8 to those shown in FIGS. 1 to 6, a chamber is defined by the outer surface of the tubular portions 2 and 4, the underside of the flange 16 and the internal surface of the shells 42 with which the flow openings 17 and communicate. Thus, when the cap is moved to the open position shown in FIGS. 1 and 5, liquid may be dispensed from the openings 17 in the upper surface of the flange 17, that is to say generally in the axial direction.

What is claimed is:

1. A dispensing cap constituting a one-piece moulding of polymeric material including a first circular section tubular portion (2) with a first radius for connection to the mouth of a liquid container and a second circular section tubular portion (6) with a second radius smaller than the first radius, one end of the first tubular portion being connected to one end of the second tubular portion by a resilient, annular, integral web (4), in which one or more flow openings (18) are formed, the width of the web being equal to or greater than the difference between the first and second radii, the other end of the second tubular portion (6) being closed, one of the web (4) and the internal surface of the first tubular portion adjacent the said one end thereof being connected to a projecting annular first sealing flange (20), the first and second tubular portions (2, 6) being coaxial and relatively movable in the axial direction between an open position, in which the second tubular portion (6) is located outside the first tubular portion (2) and the flow openings are unobstructed, and a closed position, in which the said one end of the second tubular portion is located within the said one end of the first tubular portion and the sealing flange (20) is in sealing engagement with the other of the web (4) and the internal surface of the first tubular portion (2), whereby the flow openings (18) are prevented from communicating with the interior of the first tubular portion by the sealing engagement of the first sealing flange (20) with the other of the web (4) and the internal surface of the first tubular portion (2), characterised in that the said other end of the second tubular portion (6) carries a radially projecting circumferential flange (16), that one or more flow openings (17) are formed in the circumferential flange, that the moulding further includes two half shells (42) of semi-cylindrical shape, the upper edge of each of which is integral with and sealed to the circumferential flange (16), the lower edge of each of which forms a sliding seal with the first tubular portion (2) and each side edge of each of which forms a seal with a side edge of the other of which, whereby defined within the two half shells (42) there is a liquid flow space with which the flow openings (18, 17) in the web (4) and in the circumferential flange communicate.

2. A cap as claimed in claim 1 in which each half shell (42) is integrally connected to the circumferential flange substantially at the midpoint of its upper edge by means of a hinge (40), the upper edge (44) of each half shell and the corresponding portion of the circumferential flange (16) being of complementary shape and snap connected together.

3. A cap as claimed in claim 1 in which the opposed pairs of side edges (46, 48) of the two half shells (42) are of complementary shape and are snap connected together.

4. A cap as claimed in claim 1 in which a portion of the external surface of the first tubular portion (2) is of smooth cylindrical shape and the lower edge of each half shell forms a sliding seal with the said portion as the second tubular portion (6) is moved between the open and closed positions.

5. A cap as claimed in claim 1 in which the first sealing flange (20) is integrally connected to the web (4) at a point intermediate its ends, as seen in axial sectional view, whereby when the cap is in the closed position the free edge of the first sealing flange (20) forms a substantially line seal with the internal surface of the first tubular portion (2).

6. A cap as claimed in claim 1 in which the first sealing flange (20) projects from the web (4) in a direction substantially parallel to the axis of the first and second tubular portions (2, 6), when they are in the open position.

7. A cap as claimed in claim 5 in which the internal surface of the first tubular portion (2) carries a resilient annular second sealing flange (22), which projects at an acute angle to the axis of the first and second tubular portions (2, 6) and away from the second tubular portion (6) and is positioned so that it is sealingly engaged by the first sealing flange (20), when the first and second tubular portions are in the closed position.

8. A cap as claimed in claim 2 in which the opposed pairs of side edges (46, 48) of the two half shells (42) are of complementary shape and are snap connected together.

9. A cap as claimed in claim 2 in which a portion of the external surface of the first tubular portion (2) is of smooth cylindrical shape and the lower edge of each half shell forms a sliding seal with the said portion as the second tubular portion (6) is moved between the open and closed positions.

10. A cap as claimed in claim 2 in which the first sealing flange (20) is integrally connected to the web (4) at a point intermediate its ends, as seen in axial sectional view, whereby when the cap is in the closed position the free edge of the first sealing flange (20) forms a substantially line seal with the internal surface of the first tubular portion (2).

11. A cap as claimed in claim 2 in which the first sealing flange (20) projects from the web (4) in a direction substantially parallel to the axis of the first and second tubular portions (2, 6), when they are in the open position.

* * * * *